United States Patent [19]

Maki et al.

[11] 3,993,483

[45] Nov. 23, 1976

[54] LIQUID DEVELOPER FOR ELECTROSTATIC IMAGE

[75] Inventors: Isamu Maki, Hoya; Masashi Kiuchi, Yokohama; Toshio Watanabe; Saburo Shoji, both of Kawasaki; Mitsuo Sato, Yokohama; Tatsuyoshi Kanai; Toshiyuki Komatsu, both of Kawasaki, all of Japan

[73] Assignee: Canon Kabushiki Kaisha, Tokyo, Japan

[22] Filed: Jan. 22, 1974

[21] Appl. No.: 435,474

[52] U.S. Cl. ..... 96/1 LY; 252/62.1 L; 252/62.1 P; 427/15; 427/16

[51] Int. Cl.[2] ..... G03G 9/00

[58] Field of Search ..... 252/62.1 L, 62.1 P; 96/1 LY; 117/37 LE; 427/15, 16

[56] References Cited

UNITED STATES PATENTS

| | | | |
|---|---|---|---|
| 2,907,674 | 10/1959 | Metcalfe et al. | 252/62.1 |
| 3,032,432 | 5/1962 | Metcalfe | 252/62.1 |
| 3,259,581 | 7/1966 | Matkan | 252/62.1 |
| 3,362,907 | 1/1968 | Matkan et al. | 252/62.1 |
| 3,576,744 | 4/1971 | Sharrock et al. | 252/62.1 L |
| 3,817,867 | 6/1974 | Nagashima | 252/62.1 L |

*Primary Examiner*—Edward C. Kimlin

*Attorney, Agent, or Firm*—Fitzpatrick, Cella, Harper & Scinto

[57] ABSTRACT

Liquid developers for use in developing electrostatic latent image which contain at least one member selected from the following Group A and at least one member selected from the following Group B.

Group A: Cumarone indene resin, rosin modified phenol resin, rosin modified maleic acid resin, rosin modified pentaerythritol resin, alkylphenol modified xylene resin, styrene-vinyltoluene copolymer, and resin acid calcium salt.

Group B: Low molecular polyethylene, ethylene-ethylacrylate copolymer, ethylene-vinylacetate copolymer, low molecular polypropylene, chlorinated paraffin (degree of chlorination, 40 to 70%), polybutene resin, $\beta$-pinene resin, polyterpene resin, and alkylphenol formaldehyde resin.

10 Claims, No Drawings

LIQUID DEVELOPER FOR ELECTROSTATIC IMAGE

BACKGROUND OF THE INVENTION

1. Field of the Invention

This invention relates to liquid developers for electrostatic latent image which are used in electrophotography, electrostatic recording, electrostatic printing, and the like. More specifically, this invention relates to liquid developers for electrostatic latent image which are particularly usable in electrophotography comprising the steps of developing an electrostatic latent image and transferring the image so developed to a transferring member.

2. Description of the Prior Art

The characteristics required for a liquid developer for use in electrophotography wherein an electorstatic latent image formed on an insulating layer or a photosensitive layer is wet-developed and the image so developed is transferred to a transferring member (see, for example, Japanese Patent Publication No. 24077/1970 ) may be given as follows: (1) the electrostatic latent image can be developed to provide an image which is of high density, clear, and fogless, (2) the image so developed is not disturbed by pressure applied at transferring step wherein the image is transferred to a transferring member and it is of transferability enough to provide a fully sharp image to the transferring paper, (3) the image transferred to the transferring member is fully fixed and (4) the liquid developer remaining on the insulating layer or the photosensitive layer is easily erasable after transferring so that the surface may be used repeatedly.

Conventional liquid developers for electrophotography have been developed mainly for developing the electostatic latent image formed on the electophotographic photosensitive paper of zinc-binder system. On using them for electrophotography wherein the developed image is transferred to the transferring member, it has been found that they have either of the following disadvantages. That is, they are of so poor transferability that even though an image of fully high density is obtained on the photoconductive or the insulating layer, the transferred image is of low density and of low quality. Furthermore, the fixation of the transferred image on the transferring paper is so poor that the transferred image is easily disturbed by rubbing slightly with a finger tip after drying a carrier liquid of the liquid developer and thus they are of no practical value. In addition, a large amount of toner remains on the insulating layer or the photosensitive layer, arising difficulty in cleaning the surface. The inferiority with time of the developer is so vigorous that it is not applicable to electrophotograpghy of transferring type.

SUMMARY OF THE INVENTION

This invention provides liquid developers for electrostatic image which have avoided the above-mentioned drawbacks.

The object of this invention is to provide improved liquid developers for use in developing electrostatic image whereby the transferability of the developed image is improved, the fixation of the image transferred to a transferring member is rendered satisfactorily sufficient and the cleaning of the residual toner on an insulating or photosensitive layer is facilitated.

Another object of this invention is to provide liquid developers for electrostatic image which are of low inferiority with time and which enable to obtain an image of high quality at high speed and to increase the number of copied papers.

The liquid developer of this invention is characterized by containing coloring agent(s), one or more compounds selected from the following A group, and one or more compounds selected from the following B group in an electrically insulating liquid. Group A: Cumarone-indene resin, rosin modified phenol resin, rosin modified maleic acid resin, rosin modified pentaerythritol resin, alkyl-phenol modified xylene resin, styrene-vinyltoluene copolymer, and resin acid calcium salt.

Group B: low molecular polyethylene (molecular weight, about 1000 to 5000), ethylene-ethylacrylate copolymer, ethylene-vinyl acetate copolymer, low molecular polypropylene, chlorinated paraffin (degree of chlorination, 40 to 70%), polybutene, $\beta$-pinene resin, polyterpene, and alkylphenol formaldehyde resin.

As one of the methods of imparting charge to a toner particle, there has been used addition of surface active agent capable of dissolving in an insulating liquid. As a result of studying a liquid developer which is most effectively, either positively or negatively, chargeable by a charge controlling agent of the surface active agent type and which is of high transferability, it has been found that mixing a pigment particle and one or more compounds selected from the group A is effective for obtaining such a developer.

That is, where there is used as a liquid developer a dispersion which is prepared by dispersing particles composed of one or more compounds selected from the group A and colored pigments in the insulating liquid, it is difficult to develop effectively an electrostatic latent image. However, it has been found that the charge of the particle can be controlled either positively or negatively by adding a proper surface active agent to the liquid.

The following compounds are preferably used to provide a positively charged particle: metal salts of naphthenic acid (wherein metal is Mn, Co, Al, Ni, Zn, Fe, etc.), and zirconium salt of aliphatic acids having alkyl group containing 8 to 20 carbon atoms. To provide a negatively charged particle, the following compounds are preferably used: phospholipid such as lecithin, cephalin, and the like, alkylalanine having alkyl group containing 8 to 20, metal salts of alkylbenzene sulfonic acid having alkyl group containing 8 to 20 carbon atoms (wherein metal is Na, Ca, Mg, K, Al, Zn, or Ba), metal salts of dialkylsulfosuccinic acid having alkyl group containing 8 to 20 carbon atoms (wherein metal is Na, Ca, Mg, K, Al, Zn, or Ba), metal salts of dialkylnaphthalene sulfonic acid having alkyl group containing 8 to 20 carbon atoms (wherein metal is Na, Ca, Mg, K, Al, Zn, or Ba), metal salts of polyoxyethylene sulfonic acid (wherein metal is Na, Ca, Mg, K, Al, Zn, or Ba) and metal salts of dialkyl phosphoric acid having alkyl group containing 8 to 20 carbon atoms (wherein metal is Na, Ca, Mg, K, Al, Zn, or Ba).

A liquid developer prepared by dispersing particle composed of at least one compound of the group A and colored pigment in an insulating liquid in which either of the above surface active agents is dissolved, can generally form an image which is clear and of high density, and is highly excellent with respect to transferring efficiency.

In order to measure the durability of the developer of this kind and particularly to find if there occurs deterioration phenomenon, such as lowering of image density in preparing a number of copied papers with a copying machine, the developer as prepared above was applied to a commercially available copying machine of the liquid developing and transferring type (NP-L7): trade name, supplied by Canon Inc.). As a result, there was obtained a copied image, which was clear and of high density, even after copying twenty thousand papers (A4 size), (Note: NP-L7 is designed such that a developer is automatically supplied depending upon the consumption thereof and, if the liquid developer is not deteriorated, it is possible to copy immeasurable number of papers without replacing the developer with a fresh one.)

Howeverr, it has been found that the developer of this kind has other disadvantages. That is, while the developer containing the compound of the group A and surface active agent provides an image which is clear and of high density and furthermore the transferability of the developed image is highly excellent, the image transferred is slightly disturbed. The disturbance is a whisker-like or dot-like one in the boundary of line image, or the unevenness of density in a big image portion (unevenness in transferring), which lowers image quality. In addition, the fixation on a transferring member is not sufficient. Moreover, as the friction resistance between the surface of photosensitive member and a blade, which is provided in contact with the surface of photosensitive member so as to remove the developer remaining on the insulating layer or the photosensitive member after transferring of image, is large and thus the blade sometimes vibrates making a noise. Due to the vibration of the blade, the cleaning effect becomes insufficient. If a small gap exists at a place between the photosensitive member and the blade, there appears an insufficiently erased stripe on the surface of the photosensitive member corresponding to the small gap. During repeated copying operation, the amount of the developer remaining on the stripe is increased and thus it follows that there appears a stripe-like stain in the transferred image.

The new problems as stated above can be solved by using one or more compounds selected from the above group B.

DESCRIPTION OF THE PREFERRED EMBODIMENT

We inventors have found that liquid developers which are excellent in respect of transferring, fixation, and cleaning can be obtained by employing the compounds of the above-mentioned groups A and B. There will be given below the ratios of components constituting electrophotographic liquid developer of this invention which provide an image, which is of high density, clear, and fogless, and which are, as stated above, excellent in respect of transferability, fixability to transferring member, and cleaning.

The amount of coloring agent is within the range of about 0.05 to 2.0 grams per liter of an electrically insulating liquid (carrier liquid). The total weight of compounds selected from the groups A and B is about 2 to 10 times that of the coloring agent. The ratio of the compound of the group A to the compound of the group B is within the range of 100 parts by weight to (60 to 400) parts by weight.

As the electrically insulating liquid as herein used, there may be used any known electrically insulating liquid usable for the carrier liquid of the electrophotographic liquid developer. This, there may be used aliphatic hydrocarbons, aromatic hydrocarbons, halogenated hydrocarbons, and the like which have electric resistivity of $10^{10}\Omega$-cm or more and specific inductive capacity of 3 or less. For example, there may be given n-pentane, cyclohexane, naphtha, kerosene, light oil and the like.

As the coloring agent, there may be used any of conventional pigments and dye stuffs for use in preparing electrophotographic developer. Particularly, where three colored developers of blue, magenta, and yellow are prepared by using Phthalocyanine Blue, Toluidine Red, Lake Red, Hansa Yellow, Benzidine Yellow, and the like in place of carbon black and and the like, they are very suitable liquid developers for color electrophotography.

The electrophotographic liquid developer of this invention may be applicable to any electrophotography wherein an electric latent image formed on a zinc oxide-binder system photosensitive layer, or an inorganic such as amorphous selenium or organic photoconductive layer, or an insulating layer is developed and then transferred to a transferring member.

This invention is explained in detail by the following examples.

EXAMPLE 1

Rosin modified pentaerythritol resin (Pentacite P-423; trade name, manufactured by Dai Nippon Ink & Chemicals Inc.) . . . 3.0 grams Ethylene-ethylacrylate resin (DPDJ-9196; trade name, manufactured by Nippon Unikar Co.) . . . 0.5 grams Low molecular weight polyethylene (Sanwax 171-P; trade name, manufactured by Sanyo Kasei Co.) . . . 2.5 grams Solvesso 100 (trade name, manufactured by Esso) . . . 30 grams The above mixture was heated up to 80° C with stirring to form a homogeneous solution. 2.0 g of carbon black and 80 mg of lecithin were added to the homogeneous solution and mixed. Then 50 ml of Isopar G (trade name) was added and dispersed with a ball mill for 24 hours to prepare a raw liquid developer.

The raw liquid developer was diluted with 2 l of Isopar G and used as a liquid developer for a copying machine of the liquid-developing/transferring type on the market. The developer was fixed completely on a transferring paper and there was thus obtained a clear image which was of high density and fogless. On continuing copying operation, it was confirmed that clear image was copied onto twenty thousand of papers. Neither vibration noise of a blade nor stripe stain was observed.

In this copying operation, toner particle and Isopar G, when consumed, were automatically supplemented and the supplement of the toner particle was carried out using the above raw liquid developer.

On the other hand, a developer was prepared in the same manner as stated above using only 6 g of rosin modified pentaerythritol resin excluding ethylene-ethylacrylate resin and low molecular weight polyethylene. On testing the developer so prepared, vibration noise was observed from the beginning and after copying about 2000 of papers, fine stripe like stain was observed.

Another developer was prepared in the same manner as described above except that only 1 g of ethylene-ethylacrylate and 5 g of polyethylene were used and that rosin modified pentaerythritol resin was excluded. While the developer so obtained was excellent in respect of fixability, the image formed on the photosensitive member was of relatively low density and of low transfer efficiency. As a result, the image formed on a transferring paper was of extremely low density.

EXAMPLE 2

Zinc oxide . . . 100 g
Styrene-Butadiene copolymer (50% toluene solution) . . . 20 g
n-butylmethacrylate (50% toluene solution) . . . 40 g
Toluene . . . 120 g
Rose Bengale (1% methanol solution) . . . 4 ml The above ingredients were dispersed in a porcelain ball mill for 6 hours. The dispersion was coated on a 0.05 thick aluminum plate with a wire bar to form a 40 $\mu$ thick dry layer and dried by hot air to evaporate the solvent so that a photogsensitive plate of zinc oxide-binder system was prepared. The thus-prepared photosensitive plate was entirely charged with Corona discharg of −6 KV and then imagewisely exposed to form a latent image.

On the other hand, a liquid developer was prepared in the same manner as described in Example 1 except that sodium dioctylsulfosuccinate was used in place of lecithin. On developing the latent image using the above-prepared developer, a clear reverse image was formed on the surface of the photosensitive member.

A transferring paper was overlaid on the thus-obtained image and thereafter peeled off while rolling a rubber roller from behind and there was thus obtained an excellent image fixed on the transferring paper which was of sufficient density.

EXAMPLE 3

2 ml of a 1% solution of Rose Bengale in ethanol was added to 100 g of a 20% solution of poly-N-vinylcarbazole in benzene and stirred to form a homogeneous solution. The resultant homogeneous solution was coated on a 0.05 mm thick aluminum plate to form a 10 $\mu$ thick layer, when dried, and dried by hot air to prepare a photosensitive plate.

The photosensitive plate thus prepared was charged with corona discharge of −5.5 and exposed through an original pattern to form a negative latent image.

On the other hand, a liquid developer was prepared in the same manner as in Example 1 except that 80 mg of cobalt naphthenate was used in place of lecithin.

On developing the above latent image using the above prepared liquid developer, there was obtained a clear positive image on the surface of the photosensitive plate.

Immediately after developing, a transferring paper was overlaid on the photosensitive plate and peeled off while charging with corona discharge of +7KV from behind and there was then obtained a transferred image which was clear and of excellent transferability.

EXAMPLE 4

A 85 : 15 mixture of selenium grain of 99.99% purity and tellurium powder was melted in vaccum in Pylex glass vessel to form a selenium-tellurium alloy which was then placed in a fusing boat and deposited under pressure of $2 \times 10^{-5}$ torr on a 1 mm thick nickel plated brass to form a 60 $\mu$ thick layer.

The photosensitive plate so prepared was charged with corona discharge of +6KV and thereafter exposed through an original image and there was then obtained a negative latent image.

On the other hand, a developer was prepared in the same manner as in Example 1 except that calcium dodecylbenzene sulfonate was used in place of lecithin.

On developing the above latent image by the thus-prepared developer, there was obtained a clear image which was of high density and fogless. The image transferred to a transferring paper in the same manner as in Example 2 was of excellently high density and clear and furthermore of sufficient fixability.

EXAMPLE 5

Positive corona discharging was applied directly to a 38 $\mu$ thick polyester film according to an image corresponding to a signal of Braun tube from a needle electrode placed oppositely to the surface of the film to form an electrostatic image thereon.

On the other hand, the method of Example 1 was repeated using alkylalanine in place of lecithin to prepare a liquid developer. On developing the above latent image with the liquid developer as prepared above, there was obtained an image which was of high density, fogless, and clear. An image transferred to a transferring paper as in Example 2 was of extremely high density and clear, and fixing was satisfactorily sufficient.

EXAMPLE 6

Carbon black . . . 2.0 g
Rosin modified phenol resin (trade name, Beckacite 1126, manufactured by Dai Nippon Ink & Chemicals Inc.) . . . 3.2 g
Chlorinated paraffin (degree of chlorination, 70%) (trade name, Toyoparax A-70, manufactured by Toyo Soda Mfg. Co., Ltd.) . . . 4.8 g
Solvesso (trade name, manufactured by Esso) . . . 30 g The above ingredients were mixed and fully dispersed in a ball mill for 12 hours. The dispersion was further dispersed with homo mixer in a solution prepared by dissolving 80 mg of lecithin in 2 l of Isopar G (trade name) to prepare a liquid developer.

On employing the above prepared liquid developer as a liquid developer for a copying machine of liquid developing-transferring method on the market (trade name, NP-L7, manufactured by Cannon, there was obtained on a transferring paper an image which was fixed completely on the transferring paper, of high density, fogless, and sharp. Furthermore, the photosensitive plate was completely cleaned and after repeating the copying operation continuously, an excellent copied image was formed.

EXAMPLE 7

Zinc oxide . . . 100 g
Styrene-butadiene copolymer (50% toluene solution) . . . 20 g
n-butylacrylate (50% toluene solution) . . . 40 g
Toluene . . . 120 g
Rose Bengale (1% methanol solution) . . . 4 ml The above ingredients were mixed in a porcelain ball mill for 6 hours and coated with a wire bar on a 0.05 mm thick aluminum plate to form a 40 $\mu$ thick dry film and heated by hot air to evaporate the solvent to form zinc oxide-binder system photosensitive plate. The photosensitive plate was entirely charged with corona discharge of −6 KV and exposed to an original pattern to form an electrostatic image.

On the other hand, the same procedure as in Example 1 was repeated using calcium dioctylsulfosuccinate in place of lecithin to form a liquid developer. On developing the above latent image with the thus-prepared liquid developer, there was obtained a clear reverse image on the surface of the photosensitive plate.

A transferring paper was immediately placed on the thus-obtained image and peeled off while rolling a rubber roller from behind and there was then obtained an image on the transferring paper which was of sufficient image density and of excellent fixation.

EXAMPLE 8

100 g of a 20% solution of poly-N-vinylcarbazole in benzene was added to 2 ml of a 1% solution of Rose Bengale in ethanol and stirred until a homogeneous solution was obtained. The resulting solution was coated on a 0.05 mm thick aluminum plate to form a 10 $\mu$ thick layer (when dried) and dried with hot air to form a photosensitive plate. The photosensitive On the other hand, the procedure of Example 6 was repeated except that 80 mg of manganese naphthenate was used in place of lecithin to prepare a liquid developer.

On developing the above electrostatic latent image with the developer, there was obtained a clear positive image on the photosensitive member. Immediately after developing, a transferring paper was placed on the positive image and thereafter it was peeled off while charging with corona discharge of +7 KV. There was then obtained a fixed image which was of high image density.

EXAMPLE 9

A 85 : 15 mixture of granular selenium of 99.99% purity and powdered tellurium was placed in a Pyrex glass vessel and fused in vacuum to form a selenium-tellurium alloy, which was then placed in a fusing boat and vapor-deposited on a 1 mm nickel plated brass plate under the condition of $2 \times 10^{-5}$ Torr to form a 60 $\mu$ thick layer. The plate so prepared was charged with corona discharge of +6 KV and exposed to form an electrostatic image.

The procedure of Example 6 was repeated except that sodium dodecylbenzene sulfonate was used in place of lecithin to prepare a liquid developer. On developing the above image with the developer, there was obtained a fogless, sharp image. The image transferred to a transferring paper as in Example 2 was of extremely high density and sharp.

EXAMPLE 10

Positive corona charging was applied directly to a 38 $\mu$ thick polyester film according to an image responsive to a signal of Braun tube from a needle electrode placed oppositely to the surface of the film to form an electrostatic image thereon.

The thus-formed electrostatic image was developed with the same developer as in Example 6 and transferred. The transferred image was highly clear and fixation was satisfactorily sufficient.

EXAMPLES 11 TO 35

Liquid developers were prepared in the same manner as in Example 1 by combining materials as listed in Table below. On applying the thus-prepared developers to the methods of Examples 1 to 5, there were obtained transferred images which were clear and of high image density and the fixing thereof were complete.

| Example | Material selected from Group A (g) | Material selected from Group B (g) | Surface active agent (mg/l) | Polarity of toner |
|---|---|---|---|---|
| 11 | Rosin modified phenol resin 3.2 | Low molecular polyethylene 5.0 | Lecithin 40 | − |
| 12 | " | Low molecular polypropylene 8.5 | " | − |
| 13 | Rosin modified maleic acid resin 1.5 | Ethylene-ethylacrylate resin 4.5 | " | − |
| 14 | Alkylphenol modified xylene resin 1.5<br>Cumarone indene resin 1.5 | Ethylene-Vinylacetate copolymer 1.0<br>Low molecular polyethylene 3.0 | Iron naphthenate 80 | + |
| 15 | Rosin modified penterythritol resin 1.0 | Ethylene-ethyl acrylate resin 0.5<br>Low molecular polypropylene 2.5 | Zinc naphthenate 40 | + |
| 16 | Rosin modified penterythritol resin 2.0 | Ethylene-vinyl acetate copolymer 6.0 | Aluminum dioctylsulfo succinate 40 | − |
| 17 | Liquid cumarone resin 3.0 | Ethylene-ethylacrylate resin 1.0<br>Low molecular polyethylene 2.0 | Nickel naphthenate 60 | + |
| 18 | Rosin modified phenol resin 1.5<br>Rosin modified penterythritol resin 1.5 | Low molecular polyethylene 0.5<br>Low molecular polypropylene 2.5 | Lecithin 40 | − |
| 19 | Styrene-vinyl toluene copolymer 1.5 | Ethylene-ethyl acrylate resin 4.5 | Lecithin 40 | − |
| 20 | Calcium resinate 1.5 | Low molecular polyethylene 7.0<br>Ethylene-ethyl acrylate resin 1.0 | Zirconium octenate 100 | + |
| 21 | Rosin modified phenol resin 3.2 | Polybutene resin 5.2 | Lecithin 40 | − |
| 22 | " | Alkylphenol formaldehyde resin 8.7 | " | − |
| 23 | Rosin modified maleic acid resin 1.5 | $\beta$-pinene resin 4.5 | cephalin 80 | − |

-continued

| Example | Material selected from Group A (g) | Material selected from Group B (g) | Surface active agent (mg/l) | Polarity of toner |
|---|---|---|---|---|
| 24 | Alkylphenol modified xylene resin 1.5<br>Cumarone indene resin 1.5 | Chlorinated paraffin (degree of chlorination of 40%) 0.5<br>Polybutene 5.0 | Aluminum naphthenate 80 | + |
| 25 | Rosin modified pentaerythritol resin 1.0 | Polyoleffin resin 2.0<br>Alkylphenol formaldehyde resin 4.0 | Manganese naphthenate 40 | + |
| 26 | Rosin modified pentaerythritol resin 2.0 | Polybutene resin 3.5<br>Chlorinated paraffin (degree of chlorination of 50%) 2.5 | Zinc dioctyl sulfosuccinate 40 | − |
| 27 | Liquid cumarone resin 3.0 | Polyterpene resin 3.0 | Cobalt naphthenate 60 | + |
| 28 | Rosin modified phenol resin 1.5<br>Rosin modified pentaerythritol resin 1.5 | Polybutene 0.5<br>Chlorinated paraffin (degree of chlorination of 70%) 2.0 | Lecithin 40 | − |
| 29 | Styrene-vinyl toluene resin 1.5 | Polybutene resin 2.5<br>Chlorinated paraffin (degree of chlorination of 70%) 2.0 | " | − |
| 30 | Calcium resin acid 1.5 | Polybutene resin 2.5<br>Alkylphenol formaldehyde resin 2.5 | " | − |
| 31 | Rosin modified phenol resin 1.5<br>Rosin modified pentaerythritol resin 1.5 | Low molecular polyethylene 0.5<br>Ethylene-ethylacrylate 2.0 | Calcium dioctylnaphthalene sulfonate 60 | − |
| 32 | Cumarone indene resin 3.0 | Ethylene-vinylacetate copolymer 6.0 | Magnesium polyoxyethylene sulfate 60 | − |
| 33 | Rosin modified pentaerythritol resin 1.5 | Low molecular polyethylene 2.5<br>Chlorinated paraffin (degree of chlorination of 70%) 1.0 | Calcium ditetradecyl phosphate 60 | − |
| 34 | Rosin modified maleic acid resin 1.5 | Polybutene resin 4 | Tetradecylalanine 50 | − |
| 35 | Rosin modified phenol resin 4.0 | Low molecular polyethylene 3.0 | Barium dioctadecyl phosphate 100 | − |

We claim:

1. Liquid developer for electrostatic image prepared by dispersing toner in an electrically insulating liquid characterized in that the liquid developer further contains at least one member selected from the following group A and at least one member selected from the following group B.

Group A: cumarone indene resin, rosin modified phenol resin, rosin modified maleic acid resin, rosin modified pentaerythritol resin, alkylphenol modified xylene resin, styrene-vinyl toluene copolymer, and resin acid calcium salt.

Group B: low molecular polyethylene, ethylene-ethylacrylate copolymer, ethylene-vinyl acetate copolymer, low molecular polypropylene, chlorinated paraffin (degree of chlorination, 40 to 70%), polybutene resin, $\beta$-pinene resin, polyterpene resin, alkylphenol formaldehyde resin.

2. Liquid developer for electrostatic image according to claim 1 in which the liquid developer contains one or more surface active agents.

3. Liquid developer for electrostatic image according to claim 1 in which the electrically insulating liquid is an organic solvent having electric resistivity of more than $10^{10}$ $\Omega$—cm and specific dielectric constant of 3 or less.

4. Liquid developer for electrostatic image according to claim 1 in which the liquid developer contains about 0.05 to 2.0 g of coloring matter per liter of the electrically insulating liquid and the compounds selected from the groups A and B, the compounds being in an amount of about 2 to 10 times that of the coloring matter.

5. Liquid developer for electrostatic image according to claim 1 in which the weight ratio of the compound of the group A to the compound of the group B is 100 : 60 to 400.

6. Liquid developer for electrostatic image according to claim 2 in which the surface active agent is added in an amount of 2 to 200 mg per liter of the electrically insulating liquid.

7. Liquid developer for electrostatic image according to claim 2 in which the surface active agent is selected from the group consisting of metal salts of naphthenic acid, phospho lipid, alkylalanine having alkyl group containing 8 to 20 carbon atoms, zirconium salt of aliphatic acid having alkyl group containing 8 to 20 carbon atoms, metal salt of alkyl benzene sulfonic acid having alkyl group containing 8 to 20 carbon atoms, metal salt of dialkyl sulfosuccinic acid having alkyl group containing 8 to 20 carbon atoms, metal salt of dialkyl naphthalene sulfonic acid having alkyl group containing 8 to 20 carbon atoms, metal salt of polyoxyethylene sulfonic acid having alkyl group containing 8 to 20 carbon atoms and metal salt of dialkyl phosphoric acid.

8. Liquid developer for electrostatic image according to claim 1 in which the compound of the group A is selected from the group consisting of cumarone indene resin, rosin modified pentaerythritol resin, and rosin modified phenol resin and the compound of the group B is ethylene-ethylacrylate resin.

9. Liquid developer for electrostatic image according to claim 1 in which the compound of the group A is selected from the group consisting of cumarone indene resin, rosin modified pentaerythritol, and rosin modified phenol resin and the compound of the group B is low molecular polyethylene.

10. In a liquid developer for developing an electrostatic image comprising a toner dispersed in an electrically insulating liquid, the improvement by means of which an improved electrostatic latent image is developed having enhanced properties of clarity, density, foglessness, transferability, fixibility and eraseability after transfer comprising employing in said liquid developer at least one member selected from the following group A and at least one member selected from the following group B wherein the weight ratio of the group A compound to the group B compound is from 0.6:1 to 4:1;

Group A: cumarone indene resin, rosin modified phenol resin, rosin modified maleic acid resin, rosin modified pentaerythritol resin, alkylphenol modified xylene resin, styrene-vinyl toluene copolymer and resin acid calcium salt;

Group B: low molecular polyethylene, ethylene-ethylacrylate copolymer, ethylene-vinyl acetate copolymer, low molecular polypropylene, chlorinated paraffin (degree of chlorination, 40 to 70%), polybutene resin, $\beta$-pinene resin, polyterpene resin, alkylphenol formaldehyde resin.

* * * * *